US011058156B2

(12) United States Patent
Leverette

(10) Patent No.: US 11,058,156 B2
(45) Date of Patent: Jul. 13, 2021

(54) REMOVABLE UNDERWIRE FOR BRASSIERES

(71) Applicant: Jacqueline Leverette, Lake Elsinore, CA (US)

(72) Inventor: Jacqueline Leverette, Lake Elsinore, CA (US)

( * ) Notice: Subject to any disclaimer, the term of this patent is extended or adjusted under 35 U.S.C. 154(b) by 85 days.

(21) Appl. No.: 16/265,042

(22) Filed: Feb. 1, 2019

(65) Prior Publication Data

US 2019/0239574 A1 Aug. 8, 2019

Related U.S. Application Data

(60) Provisional application No. 62/627,283, filed on Feb. 7, 2018.

(51) Int. Cl.
*A41C 3/12* (2006.01)
*A41C 3/00* (2006.01)

(52) U.S. Cl.
CPC ..... *A41C 3/122* (2013.01); *A41C 3/0007* (2013.01); *A41C 3/126* (2013.01)

(58) Field of Classification Search
CPC ..... A41C 1/14; A41C 1/16; A41C 1/20
USPC ..... 450/53
See application file for complete search history.

(56) References Cited

U.S. PATENT DOCUMENTS 2,380,978 A * 8/1945 Licht ..... A41C 3/124 450/52
RE22,771 E * 7/1946 Licht ..... A41C 3/124 450/52
2,432,910 A * 12/1947 Licht ..... A41C 3/122 450/52
2,438,062 A * 3/1948 Licht ..... A41C 3/08 450/30
2,453,485 A * 11/1948 Axtell ..... A44C 7/00 63/14.2
2,489,598 A * 11/1949 Tick ..... A45D 8/14 132/284
2,595,088 A * 4/1952 Licht ..... A41C 3/0007 450/52
2,649,586 A * 8/1953 Josephson ..... A41C 3/0007 450/41
3,030,633 A * 4/1962 Chalfin ..... A41C 1/14 2/258
3,726,286 A * 4/1973 Wolfson ..... A41C 3/0007 450/49
3,998,231 A * 12/1976 Delet ..... A41C 3/0078 450/52
4,153,062 A * 5/1979 Delet ..... A41C 3/124 450/52
4,235,240 A * 11/1980 Cousins ..... A41C 3/122 450/52
4,418,696 A * 12/1983 Delet ..... A41C 3/0078 450/52

(Continued)

*Primary Examiner* — Joceyln Bravo

(57) ABSTRACT

A removable underwire attachment that is externally inserted over a cup of a brassiere is provided. The underwire attachment may include a U-shape wire that includes a first curved portion configured with a first end seamlessly coupled to a second curved portion configured with a second end. The first end and the second end may be inserted along a bottom portion of a cup of the brassiere to removably fasten the attachment to the brassiere for additional support and shape.

9 Claims, 5 Drawing Sheets

(56) References Cited

U.S. PATENT DOCUMENTS 4,558,705 A * 12/1985 O'Boyle ..... A41C 3/122 450/52
5,363,675 A * 11/1994 Carter ..... A44C 7/009 63/12
5,782,670 A * 7/1998 Whisman ..... A41C 3/02 2/73
5,809,803 A * 9/1998 Stracuzzi ..... A44C 7/009 63/12
5,951,365 A * 9/1999 Fildan ..... A41C 3/122 450/41
6,019,662 A * 2/2000 Fildan ..... A41C 3/124 2/255
6,053,800 A * 4/2000 Lattanzi ..... A41C 3/128 450/41
6,186,862 B1 * 2/2001 Fildan ..... A41C 3/122 450/41
6,241,576 B1 * 6/2001 Hofer ..... A41C 3/122 450/41
6,334,805 B1 * 1/2002 Sawamoto ..... A41C 3/128 450/40
6,346,028 B1 * 2/2002 Fildan ..... A41C 3/122 450/41
6,425,799 B1 * 7/2002 Pai ..... A41C 3/0007 450/41
6,485,352 B1 * 11/2002 Batcha ..... A41C 3/0007 450/41
7,128,636 B1 * 10/2006 Marino ..... A41C 3/122 450/41
7,425,170 B1 * 9/2008 Herbert ..... A41C 3/122 450/41
7,429,205 B1 * 9/2008 Huang ..... A41C 3/142 2/267
8,137,154 B2 * 3/2012 Sturman ..... A41C 3/122 450/41
9,565,877 B2 * 2/2017 Martinet ..... A41C 3/065
2005/0124261 A1 * 6/2005 Martini ..... A41C 3/0007 450/41
2011/0237157 A1 * 9/2011 Scott ..... A41C 3/0021 450/41
2012/0077415 A1 * 3/2012 Dacumos ..... A41C 3/0028 450/41
2012/0171929 A1 * 7/2012 Cheung ..... A41C 3/0007 450/52
2015/0004874 A1 * 1/2015 Zhang ..... A41C 3/122 450/41

* cited by examiner

REMOVABLE UNDERWIRE FOR BRASSIERES

CROSS-REFERENCES TO RELATED APPLICATIONS

This application is a non-provisional and claims benefit of U.S. Patent Application No. 62/627,283, filed Feb. 7, 2018, the specification(s) of which is/are incorporated herein in their entirety by reference.

FIELD OF THE INVENTION

The present invention relates to brassieres, more specifically to a removable and/or interchangeable underwire that is externally inserted in the brassieres.

BACKGROUND OF THE INVENTION

A bra, short for brassiere, is a form-fitting undergarment that is worn to support and cover the wearer's breasts. Bras come in different types and sizes. Underwire bras are a type of bra that uses a thin, semi-circular material made of metal, plastic, or resin, that is fitted inside the fabric of the bra and runs along the bottom and/or sides of the bra cups. As such, the underwire of the bra offers support under the cup and provides additional reinforcement and shaping.

However, the underwire positioned along the sides of the bra cup, can be uncomfortable and constrictive and can put pressure on the sides of a woman's breasts, for example. Underwire bras can sometimes rub and pinch the breast, causing skin irritation and breast pain, and the wire of a worn bra can protrude from the fabric (due to normal wear, washing, or tear) and scrape or cut the skin. When the fabric of worn bra exposes an underwire, skin contact with nickel and other metals may cause contact dermatitis in some women.

Since the underwire is typically stitched into the fabric of the bra, it can only be removed by cutting it from the fabric of the bra, thereby destroying the structural integrity of the bra. Accordingly, there is a need for a new and improved bra that does not have the problems associated with known underwire bras.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a U-shaped underwire attachment coupled to a brassiere, the attachment comprising a first curved portion seamlessly coupled to a second curved portion such that a first end of the first curved portion and a second end of the second curved portion are adjacent to each other, wherein the first end and the second end are configured to slide along a bottom portion of a cup of the brassiere such that said bottom portion of the cup is disposed in between the first curved portion and the second curved portion, thereby removably fastening the attachment to the brassiere and providing additional support and shape. Thus, the U-shaped underwire attachment may be inserted over the fabric of any type of brassiere, if additional support and shaping are needed. Herein, the underwire attachment is an external attachment that is not sewn into the fabric of the brassiere. Hence, the underwire attachment may be removed easily.

Some of the unique and inventive technical features of the present invention are that the underwire attachment is an external piece that is inserted over the fabric of the brassiere to provide structural support for the wearer. The underwire attachment of the present invention is detachable and can be inserted along the bottom of the bra cups only when needed. Without wishing to limit the invention to any theory or mechanism, it is believed that the technical feature of the present invention advantageously provides for a detachable or removable underwire attachment that provides support and conforms to the user. There may be times when a user may not wish to have the support of an underwire. During such times, the user can conveniently remove the underwire attachment of the present invention. Additional advantages of the present invention include its ease-of use, comfort, safety, appearance, and low manufacturing costs. None of the presently known prior references or work has the unique inventive technical feature of the present invention.

BRIEF DESCRIPTION OF THE DRAWINGS

The features and advantages of the present invention will become apparent from a consideration of the following detailed description presented in connection with the accompanying drawings in which.

DESCRIPTION OF PREFERRED EMBODIMENTS

Figure 1:
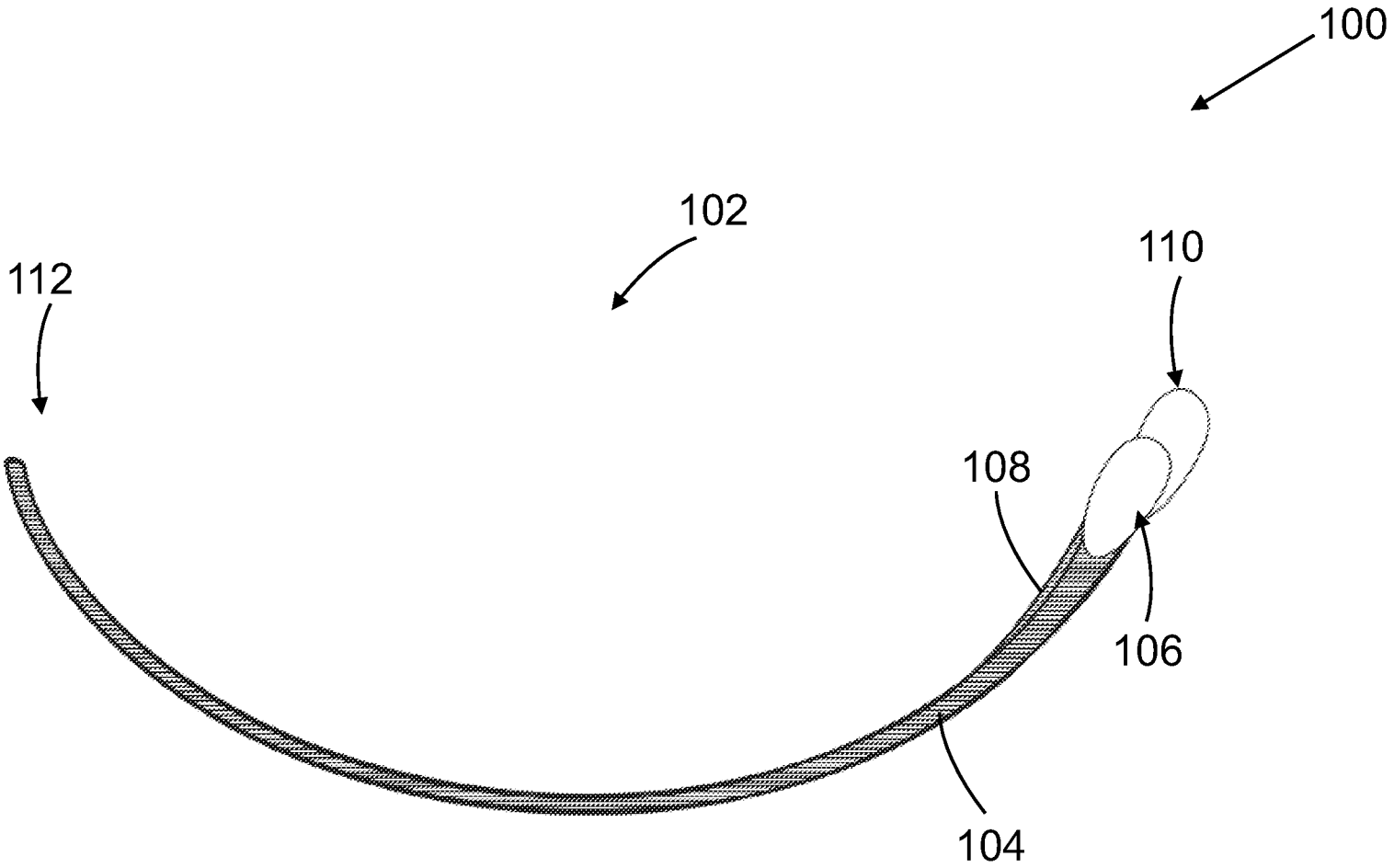
FIG. 1 shows an exemplary embodiment of an underwire attachment coupled to a brassiere.

Following is a list of elements corresponding to a particular element referred to herein:

100 schematic view
102 underwire attachment
104 first curved portion
106 first end
108 second curved portion
110 second end
112 third end
200 side view
300 schematic view
302 brassiere
304 left cup
306 right cup
308 sides
310 bottom portion Typically, underwire brassieres include a wire or metal that is sewn into the fabric of the brassiere that can be very uncomfortable after continued use and washing. Sometimes, the underwires may tear out of the fabric and protrude from the bras and bruise or puncture the wearer. In order to overcome such an issue, an example embodiment of the present invention includes an underwire attachment (102) is an external attachment that is worn over or outside the fabric of the brassiere, as discussed below.

Referring now to FIG. 1-4, the present invention features a U-shaped underwire attachment (102) that may be coupled to a brassiere or bra (302). In one non-limiting example, the brassiere (302) may be a soft cup bra that does not include an underwire stitched into the fabric of the bra. As shown in schematic view (100) of FIG. 1, the U-shaped underwire attachment (102) comprises a first curved portion (104) having a first end (106) seamlessly coupled to a second curved portion (108) having a second end (110). The first curved portion (104) and the second curved portion (108) are held close together. The first curved portion (104) is seamlessly or fluidically coupled to the second curved portion (108) along a third end (112). The third end (112) is opposite to each of the first end (106) and the second end (110). In the schematic view (100), the second curved portion (108) is behind the first curved portion (104).

Figure 2A:
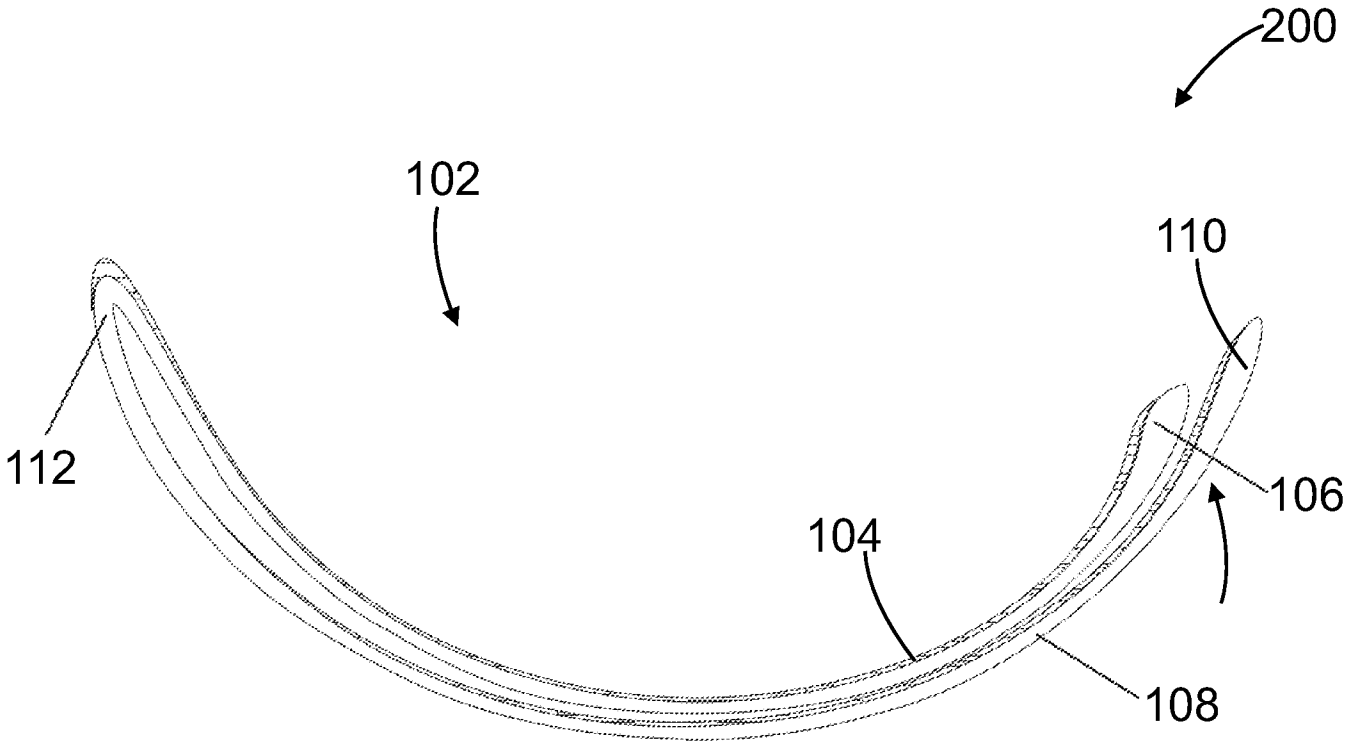
FIG. 2A shows a side view of the underwire attachment having two curved portions that are seamlessly coupled together.
Figure 2B:
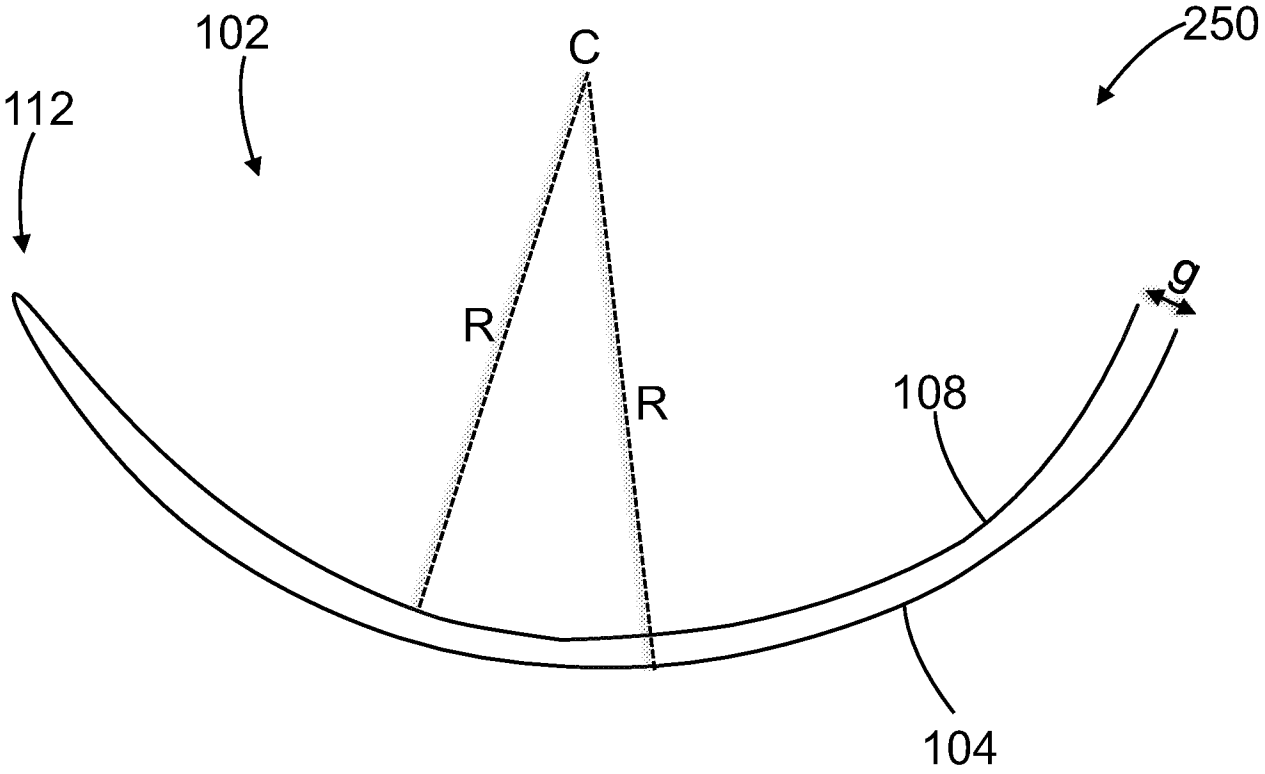
FIG. 2B shows a line drawing of the underwire attachment.
Figure 3:
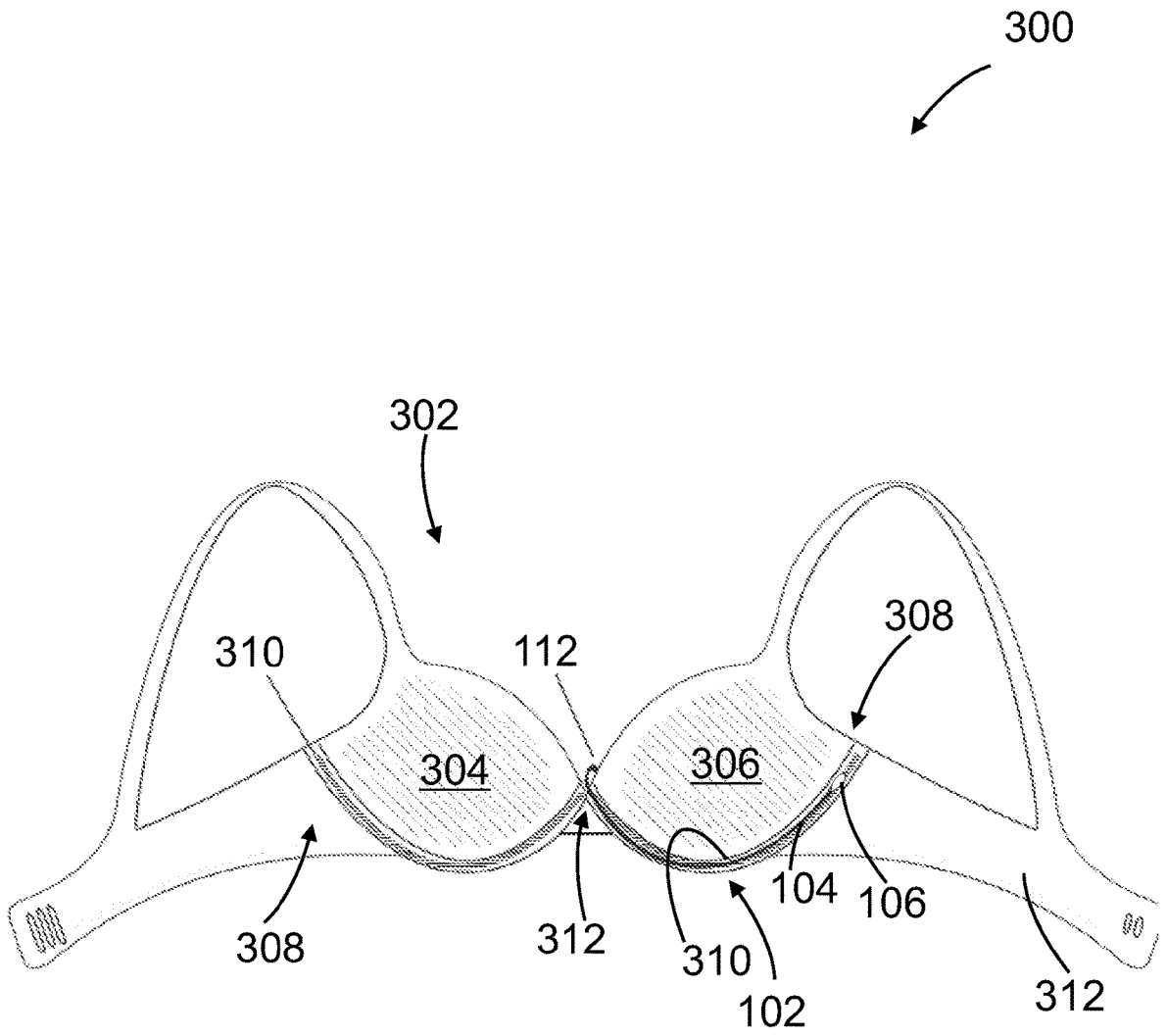
FIG. 3 shows the underwire attachment inserted under a right cup of the brassiere.
Figure 4:
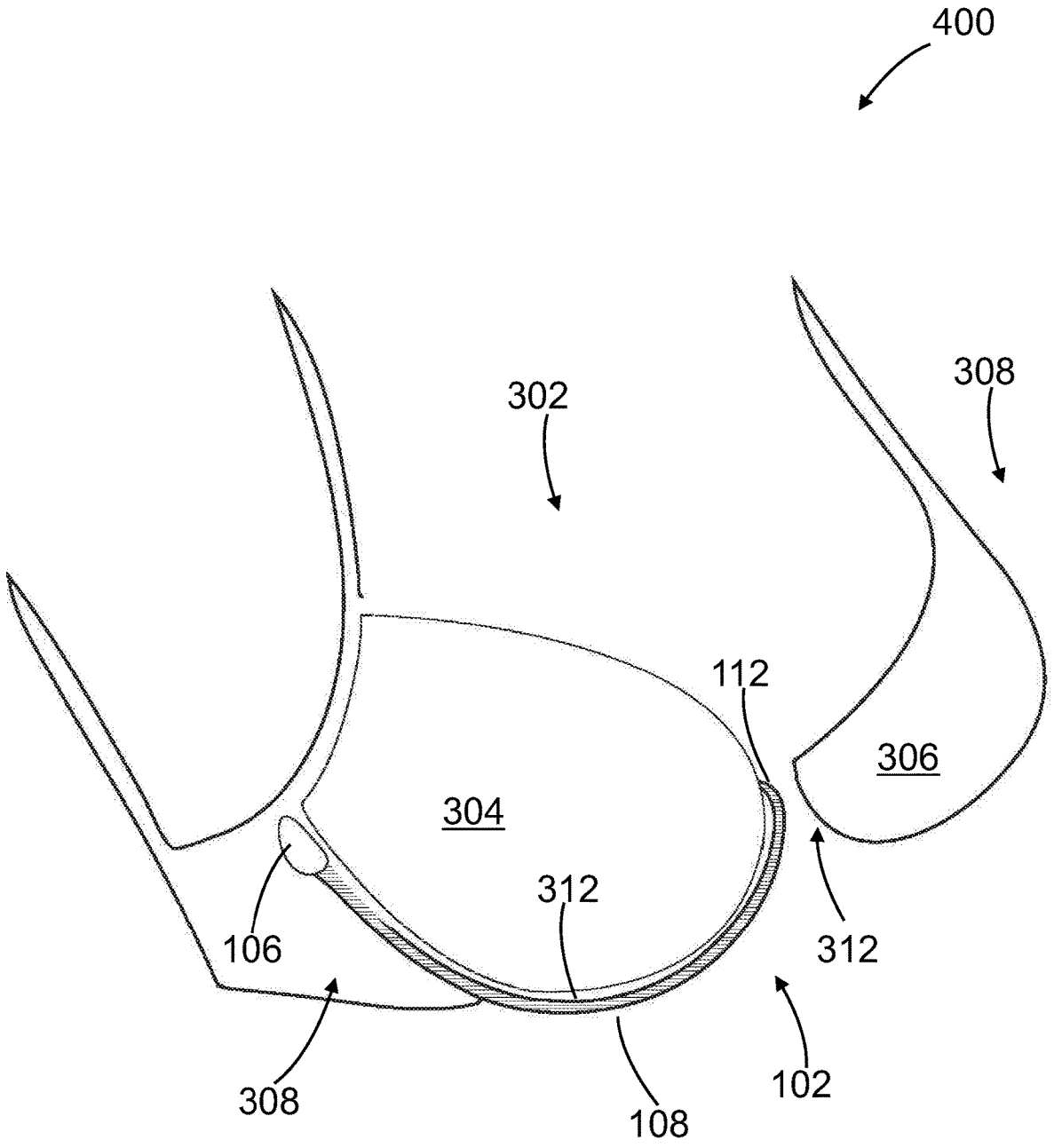
FIG. 4 shows the underwire attachment inserted under a left cup of the brassiere.

For illustrative purposes, the first and the second curved portions are shown in a side view (200) of FIG. 2A, and a line drawing (250) of the underwire attachment (102) of FIG. 2B. Herein, the first curved portion (104) is separated from the second curved portion (108) by a gap, g. The gap, g may not be uniform. For example, the gap, g between the first curved portion (104) and the second curved portion (108) may be smallest at the third end (112) and largest at the first and second ends. Together, the first curved portion (104) and the second curved portion (108) joined at the third end (112) form a sprung hairpin-like structure that is inserted over a bottom surface of the brassiere. As such, each curved portion (104, 108) of the underwire attachment (102) may be an arc or semi-circular shape of radius, R and an arc length, L. The arc length L of the first and the second portions may be adjusted based on a cup size of the brassiere. As an example, a 30 A cup size may warrant an underwire attachment of smaller arc length, while a 36 D cup size may warrant an underwire attachment of larger arc length. Thus, a single user may only need one set of underwire attachments (102) which can be interchangeably used with different of brassieres. The first curved portion (104) and the second curved portion (108) may include a width W. In one non-limiting example, the first end (106) and the second end (110) may be wider than the first curved portion (104) and the second portion (108). In another non-limiting example, the underwire attachment may be of uniform width.

The first end (106) and the second end (110) are inserted along a bottom portion (310) of a cup (304, 306) of the brassiere (302). For example, an underwire attachment (102) may be inserted along a right cup (306) and another underwire attachment (102) may be inserted along a left cup (304) of the brassiere (302) as shown in schematic views 300 and 400 of FIGS. 3 and 4.

When the underwire attachment (102) is inserted along the right cup (306), the first curved portion (104) may be in face-sharing contact with a first surface along a bottom portion (310) of the right cup (306). In addition, the second curved portion (108) may be in face-sharing contact with a second surface (not shown in FIG. 3) along the bottom of the right cup (306). The first surface and the second surface may be the front and back surface of the right cup (306), for example. The underwire attachment (102) inserted over the fabric of the right cup (306) may rest snugly along the bottom surface of the right cup (306) thereby offering additional support to the wearer of the brassiere (302). In a similar way, the underwire attachment (102) may be inserted along the left cup (304) of the brassiere (102). However, for the underwire attachment (102) to confirm to the shape of the left cup (304), the underwire attachment (102) may be rotated 180° such that the second curved portion (108) is in face-sharing contact with a first surface (312) along a bottom of the left cup (304). Herein, the first curved portion (104) may also be in face-sharing contact with a second surface (not shown in FIG. 4) along the bottom of the left cup (304). Similar to the right cup (306), the first surface (312) and the second surface may be front and back surfaces of the right cup (306) and the underwire attachment (102) inserted over the fabric of the left cup (304) may rest snugly along the bottom surface of the left cup (304) thereby offering additional support to the wearer of the brassiere (302). In this way, the underwire attachment (102) may be interchangeably used for both the right and left cups of the brassieres.

It may be appreciated that the underwire attachment (102) is inserted at a center (312) located between the right cup (306) and the left cup (304) of the cup, and extends towards sides (308) of the brassiere. Said another way, the third end (112) of the underwire attachment (102) is proximate to the center (312) of the brassiere (302) and distal to the sides (308) of the brassiere, while the first and second ends (106, 110) of each of the underwire attachment (102) are proximate to the side (308) and distal to the center (312) of the brassiere (302).

The underwire attachment (102) may be fabricated or manufactured as a continuous piece having smooth surfaces and ends without any kinks or pointed edges. For example, each of the first end (106), the second end (110), and the third end (112) may be rounded and not sharp. In this way, user discomfort may be reduced. In addition, by having the underwire attachment (102) as a smooth piece, the user may be able to insert it under the cups without poking or hurting the user. In one non-limiting example, the underwire attachment (102) may be entirely composed of one material. Herein, each of the first curved portion, the second curved portion, the first end, and the second end may be composed of same material. Some non-limiting examples of the materials include metal, plastic, and resin. In further embodiments, an interior surface of the underwire attachment (102) may be lined with silicone, or like material, to prevent the underwire attachment (102) from slipping or moving. In some example embodiments, the underwire assembly (102) may be manufactured by bonding different parts. In such embodiments, the first curved portion, the second curved portion, the first end, and the second end may be composed of different materials and finally bonded or glued together to form the U-shaped underwire attachment (102).

The underwire attachment (102) may be removed from under the cups when not in use. For example, when the brassiere is washed, the user may remove the underwire attachments before placing the brassiere in the wash, thus extending the life of both the underwire attachment and the brassiere. In addition, by removing the underwire attachment before washing, the shape of the underwire attachment may be maintained.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A brassiere comprising:

at least one brassiere cup (304, 306);

and a U-shaped underwire attachment (102), wherein the attachment comprises:

a first curved portion (104); and a second curved portion (108);

the attachment further comprising a first end (106), a second end (110), and a third end (112) opposite to each of the first and second ends, wherein the first end defines a free end of the first curved portion, the second end defines a free end of the second curved portion, and the first and second curved portions are seamlessly coupled to one another at the third end;

wherein the first end (106) and the second end (110) are directly adjacent to each other and are separated by a gap (g);

wherein the first end (106) and the second end (110) are configured to slide along a bottom portion of a respective cup of the at least one brassiere cup (304, 306), such that when the underwire attachment is coupled to the respective cup, the bottom portion of the respective cup is disposed in between the first curved portion (104) and the second curved portion (108), and at least a portion of the bottom portion of the respective cup is disposed within the gap separating the first and second ends of the underwire attachment, thereby allowing the underwire attachment to be removably fastened to the brassiere and providing additional support and shape;

wherein, when the underwire attachment is fastened to the respective cup, the first curved portion (104) is in direct contact with a first surface of the respective cup, and the second curved portion (108) is in direct contact with a second surface of the respective cup, wherein the first and second surfaces are opposite front and back surfaces of the same respective cup.

2. The brassiere of claim 1, wherein the first curved portion (104) and the second curved portion (108) are arcs of equal lengths.

3. The brassiere of claim 2, wherein the first end (106) and the second end (110) are configured to be located proximate to a lateral side (308) of the respective cup, and the third end (112) is configured to be located proximate to a center (312) of the brassiere (302).

4. The brassiere of claim 2, wherein each of the first end (106), the second end (110), and the third end (112) are rounded.

5. The brassiere of claim 1, wherein a length of each of the first curved portion (104) and the second curved portion (108) is configured to be adjusted based on a cup size of the brassiere (302).

6. The brassiere of claim 5, wherein the length of each of the first curved portion (104) and the second curved portion (108) are equal.

7. The brassiere of claim 1, wherein the first curved portion (104), the second curved portion (108), the first end (106), and the second end (110) are composed of a same material.

8. The brassiere of claim 7, wherein the material comprises one or more of metal, plastic, and resin.

9. The brassiere of claim 1, wherein the first curved portion (104), the second curved portion (108), the first end (106), and the second end (110) are composed of different materials.

* * * * *